United States Patent [19]

Asahi

[11] 4,136,260

[45] Jan. 23, 1979

[54] OUT-OF-HEAD LOCALIZED SOUND REPRODUCTION SYSTEM FOR HEADPHONE

[75] Inventor: Nobumitsu Asahi, Tokyo, Japan

[73] Assignee: Trio Kabushiki Kaisha, Tokyo, Japan

[21] Appl. No.: 797,770

[22] Filed: May 17, 1977

[30] Foreign Application Priority Data

May 20, 1976 [JP] Japan ..... 51-58193
Nov. 19, 1976 [JP] Japan ..... 51-139699

[51] Int. Cl.[2] ..... H04R 5/04
[52] U.S. Cl. ..... 179/1 G; 179/1 D
[58] Field of Search ..... 179/1 G, 15 BT, 1 D, 179/100.4 ST

[56] References Cited

U.S. PATENT DOCUMENTS

| | | | |
|---|---|---|---|
| 3,088,997 | 5/1963 | Bauer | 179/1 G |
| 3,110,771 | 11/1963 | Logan et al. | 179/1 J |
| 3,236,949 | 2/1966 | Atal et al. | 179/1 G |
| 3,920,904 | 11/1975 | Blauert et al. | 179/1 G |
| 3,962,543 | 6/1976 | Blauert et al. | 179/1 G |
| 3,970,787 | 7/1976 | Searle | 179/1 G |

FOREIGN PATENT DOCUMENTS 2557516 7/1976 Fed. Rep. of Germany ..... 179/1 G

OTHER PUBLICATIONS

"On the Differences Between Localization and Lateralization", by Plenge, *J. Acoust. Soc. Am.*, vol. 56, No. 3, Sep. 1974, pp. 944–951.

"Sound Localization in the Median Plane" by Blauert, *Acustica*, vol. 22, pp. 205–213.

*Primary Examiner*—Douglas W. Olms
*Attorney, Agent, or Firm*—Gerald J. Ferguson, Jr.; Joseph J. Baker

[57] ABSTRACT

In stereo sound reproduction circuitry for use with a stereo signal source and stereo headphones, the improvement of dip filter means disposed between the stereo signal source and the stereo headphones, the dip filter means having a dip in the transmission characteristic thereof, the dip being in substantially the same frequency position as a dip which occurs in the sound pressure frequency response characteristic at the ear canal entrance when a sound source is disposed in front of a listener.

3 Claims, 12 Drawing Figures

FIG. 4
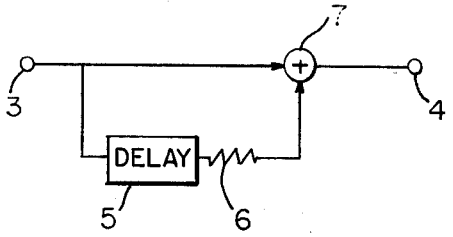
FIG. 5
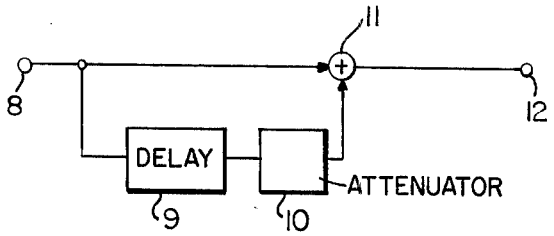
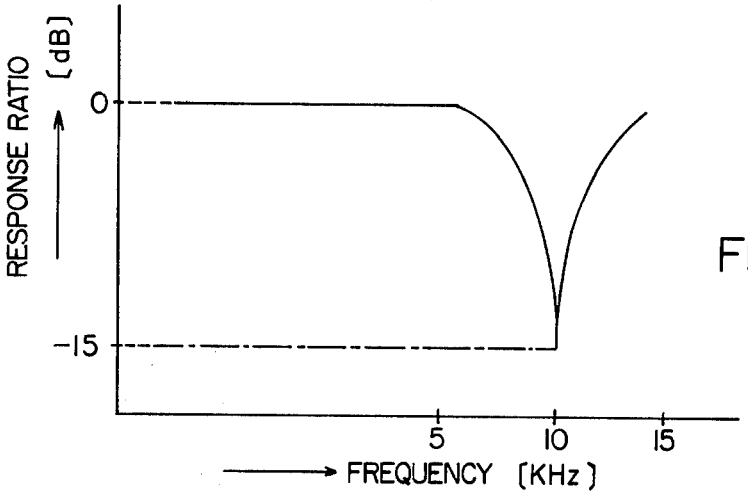
FIG. 6
FIG. 7
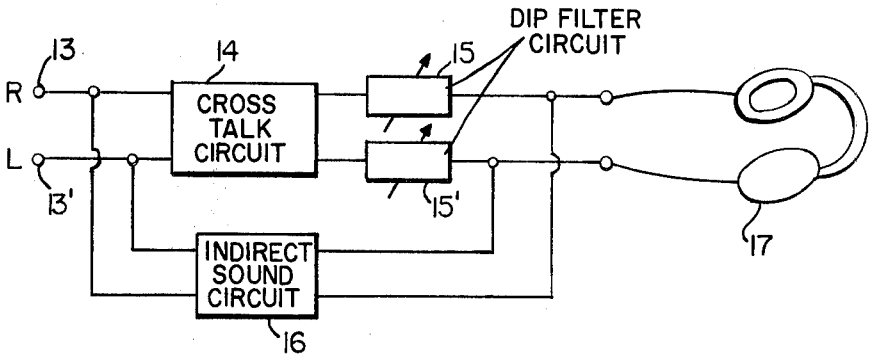

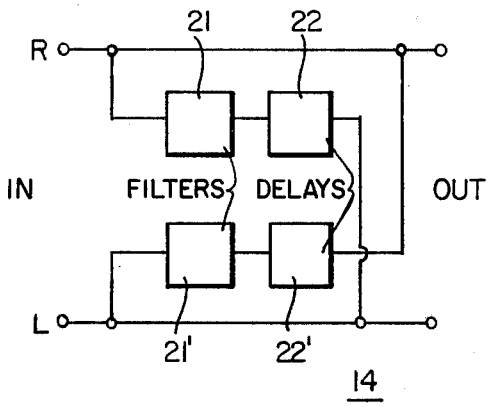
FIG. 9.
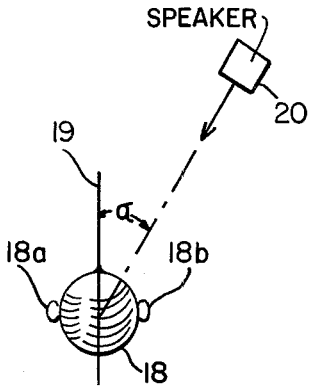
FIG. 8.
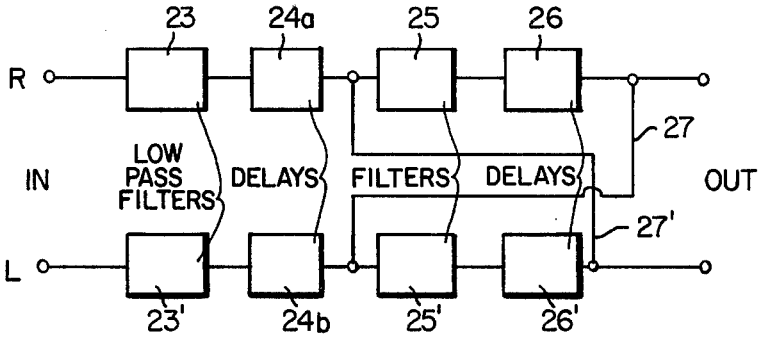
FIG. 10.
FIG. 11.
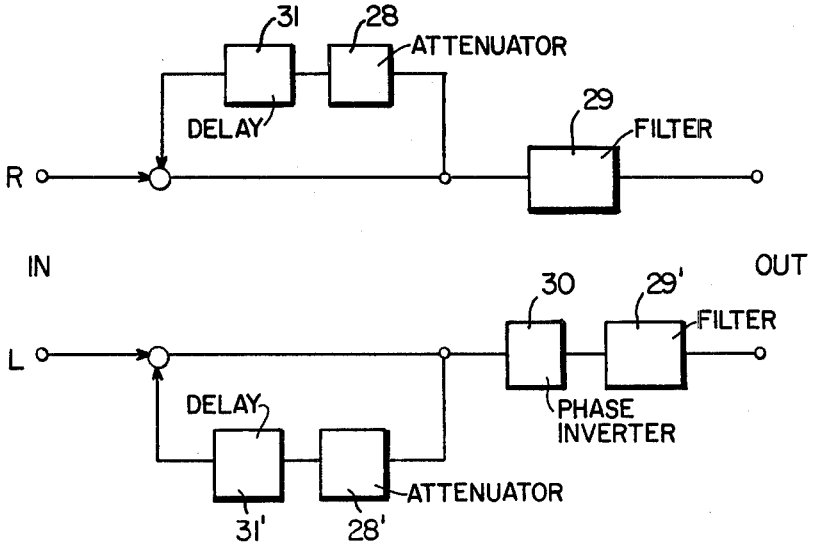

OUT-OF-HEAD LOCALIZED SOUND REPRODUCTION SYSTEM FOR HEADPHONE

BACKGROUND OF THE INVENTION

1. Field of the Invention

This invention is directed to a signal treatment device for stereophonic reproduction by headphones in which an anterior homing sense is achieved.

2. Discussion of the Prior Art

In sound reproduction by previous headphones, the stereo signal intended for speaker use is usually applied in an unaltered state to the left and right reproduction devices of the headphones. However, the perceived sound is unnatural and tiring in comparison to the sound perceived in an actual sound field in which a sound picture arises in the head near and between the ears.

Accordingly, a device has previously been suggested which would add sounds as cross talk signals or as delayed signals to each channel beyond those reproduced at each ear of the listener in the case of speaker reproduction, specifically, sounds diffracted at the head and sounds reflected by walls in order to reduce the defects cited previously. However, when the device is used, the sound picture beyond the head is still static. That is, while the sense of expansion to the left and right is relatively natural, the sound picture which arises in the head completely lacks the sense of forward expansion. Thus, the natural homing sense does not develop as in the case of speaker reproduction.

SUMMARY OF THE INVENTION

Accordingly, the objective of this invention is the achievement of a stereophonic sound reproduction device by headphones so that the forward homing sense is realized in addition to the homing sense beyond the head.

BRIEF DESCRIPTION OF THE DRAWING

FIG. 4 is an equivalent circuit of FIG. 3.

FIG. 5 is a dip filter circuit made on the basis of FIG. 4 which provides the dip characteristics of FIG. 2.

FIG. 6 illustrates dip characteristics provided by the circuit of FIG. 5.

FIG. 7 is a block diagram of a circuit which converts the speaker signals into stereophonic sound signals for headphones.

FIG. 8 is a diagram used to explain interaural difference.

FIG. 9 is a block diagram of a cross talk circuit.

FIG. 10 is a block diagram which illustrates a simple reflected sound accessory circuit.

FIG. 11 is a block diagram which illustrates a echo component accessory circuit.

DETAILED DESCRIPTION OF THE PREFERRED EMBODIMENT

In general, human beings perceive the direction of sound incidence three dimensionally (left-right, up-down, forward-backward). The left-right directional sense is known to be perceived by the interaural time difference and level difference when sound waves reach the head.

On the other hand, the primary physical cause of the up-down, forward-backward directional perception is the sound wave distortion (spectrum change including phase) caused by the pinna.

Figure 1:
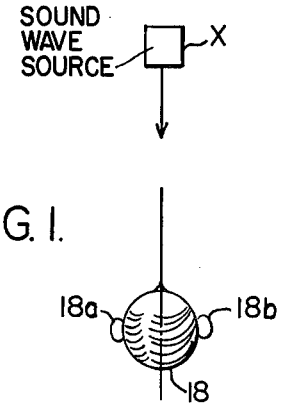
FIG. 1 illustrates the source direction for a listener of sound on a median plane.
Figure 2A:
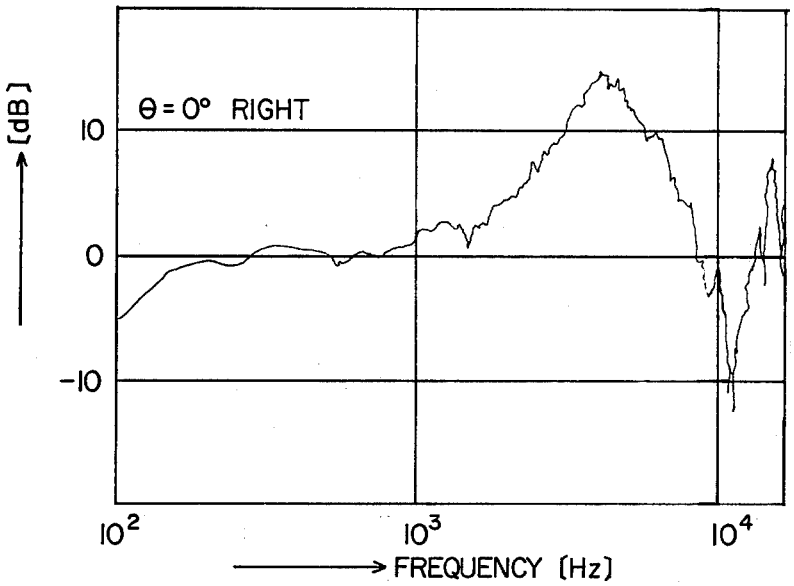
FIGS. 2(*a*) and 2(*b*) illustrate the actual sound pressure frequency characteristics of the state shown in FIG. 1 measured at the ear canal entrance where FIG. 2(*a*) illustrates the right ear and FIG. 2(*b*) illustrates the left ear.
Figure 2B:
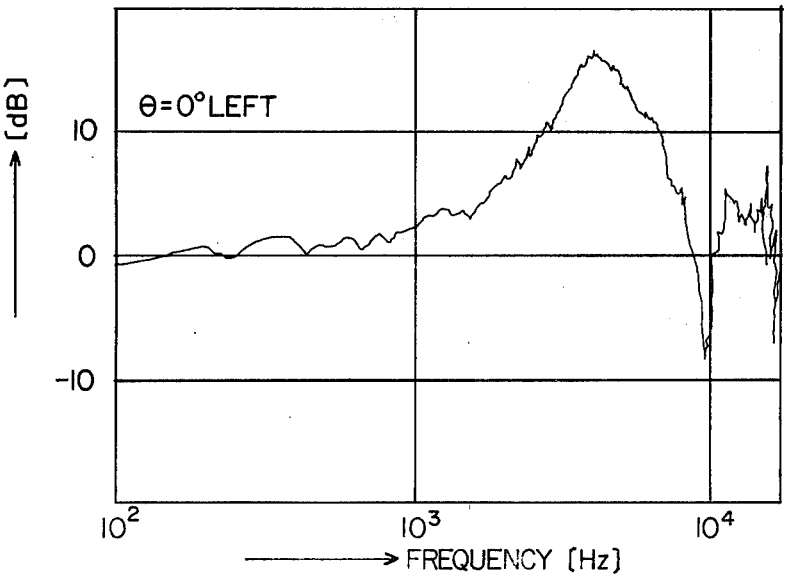

FIG. 2 illustrates the sound pressure frequency response amplitude characteristics at the ear canal entrance in the case of incidence to the head of sound waves from the anterior median plane as shown in FIG. 1. FIG. 2(*a*) illustrates characteristics of the right ear while 2(*b*) is directed to the left ear. According to FIGS. 2(*a*) and 2(*b*), there is a rise in sound pressure in the vicinity of 3–6 kHz as well as a characteristic dip in the vicinity of 8–10 kHz. It is believed the frequency position of the dip primarily defines the angle of incidence in perception.

Figure 3:
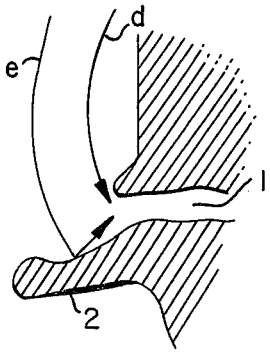
FIG. 3 is a model of the reflection effect due to the pinna.

This dip is believed to arise due to phase interference based on pinna reflection. FIG. 3 illustrates an approximation model of this. Ray d represents sound with direct incidence to the ear canal 1 while ray e represents sound reflected by the pinna 2. FIG. 4 illustrates an equivalent circuit. In FIG. 4, the sound entering at an input point 3 reaches a direct adder 7 by a path corresponding to direct sound and a path corresponding to reflected sound via a delay circuit 5. The signal proceeding via delay circuit 5 passes through a resistance 6 which corresponds to the portion absorbed by the pinna and is then added to the direct signal in adder 7. The sound is then audible as input 4 to the ear.

The above clearly indicates that when hearing stereo signals for speakers through the use of headphones, the signals should be treated so as to have dip characteristics corresponding to the characteristics of FIG. 2 which were attained experimentally. These signals should then be added to the headphones in order to attain the same forward homing sense as in conventional sound fields. Accordingly, an approximation can be achieved by concrete treatment of signals involving the addition of signals with suitable delay times to the basic signal as in the equivalent circuit of FIG. 4.

However, the dip characteristics shown in FIG. 2 vary with pinna construction so there will be differences among individuals. Since there are also interaural differences in the same individual, the left and right channel must be established independently to match individual characteristics and they must be variably adjustable. The variable range of the dip frequency position should be 7–13 kHz and experiments have indicated that a dip of 10–20 dB will accommodate virtually all people.

A concrete explanation follows of the means for treating signals for speaker use so that they can be used in headphones based on the above sort of experimental results. FIG. 5 is an example of a dip filter circuit for attaining an approximation of the dip characteristics shown in FIG. 2. The circuit structure is based on the equivalent circuit of FIG. 4. In FIG. 5, 8 is the input terminal. The signal introduced at input terminal 8 branches into two paths. One path is for the direct signal which passes through the circuit while the other path is for a signal which reaches adder 11 after delay by a delay circuit 9 with delay $\Delta t$ and attenuation to a suitable level by an attenuator 10 with attenuation k. The output is then directed to terminal 12.

When T (jω) is the transmission function of this dip circuit, $$T(j\omega) = 1 + Ke^{-j\omega\Delta t}.$$

The amplitude term |T (jω)| becomes $$|T(j\omega)| = \sqrt{K^2 + 2K\cos\omega\Delta t + 1} \quad (1)$$

Accordingly, when we provide a suitable delay time Δt to this formula, frequency characteristics with a dip at 1/2 Δ t (Hz) are achieved. FIG. 6 illustrates the frequency characteristics when selecting the delay time Δt of the circuit of FIG. 5 to be 50 μsec and the attenuation rate K to be 0.7 (−3 dB). A 15 dB dip occurs at 10 kHz. The above indicates that the position of the dip can be easily changed by altering the delay time Δt of delay circuit 9. Since the degree of dip can be adjusted by changing the amount of attenuation k of attenuator 10, the signal can be treated so as to match the dip characteristics of the individual ear.

FIG. 7 is a block diagram of an example of a concrete embodiment for achieving a stereophonic effect with the stereophonic sound reproduction device of this invention. The signal for speaker use on two input paths 13 and 13' provides cross talk proportional to the sound diffracted at the head by a cross talk circuit 14. Treatment to provide depth for anterior homing is achieved by dip filter circuits 15 and 15' which are established in each path as shown in FIG. 5. Accordingly, the respective reproduction units of the headphones receive an output proportional to direct sound while they also receive a signal proportional to echo and reflection by an indirect sound accessory circuit 16 which is established parallel to the circuit which provides direct sound. This second circuit branches from the input paths 13 and 13'.

FIG. 8 illustrates an explanation concerning interaural difference. In the case of sound emanating from a speaker 20 placed at an angle α to the median plane 19 of a listener 18, if it is assumed the sound entering ear 18b nearest the speaker is P (ω), the other ear 18a receives a signal k (ω)$e^{-j\omega\Delta t}$.P (ω) with a level difference function k (ω) and a time difference Δt. As illustrated in the cross talk circuit of FIG. 9, the signal treatment proportional to this interaural difference involves the mutual addition to the other channel of a signal passing through filters 21, 22' having transmission functions k (ω) and through delay circuits 22 and 22' having delay times Δt.

The explanation concerning indirect sound involves a division of indirect sound into simple reflection and echo components. Reflected sound is separated by direction from direct sound. It is considered to have a delay time and attenuated level (degree of attenuation is a function of frequency). It can be achieved through use of the reflected sound accessory circuit shown in FIG. 10. In FIG. 10, 23 and 23' are filters proportional to the spectrum ratio of direct sound. Low pass filters with a cut-off frequency of 1 kHz and a slope of 6 dB/OCT are suitable. 24a and 24b are delay circuits proportional to the time lag of reflected sound versus direct sound. A lag of 10–30 m.sec is best. The lag time between the two channels, specifically between 24a and 24b, must be different. 25 and 25' are filters of the level difference function which arises at both ears when reflected sound arises. 26 and 26' are delay circuits proportional to the interaural time difference when reflected sound arises. Paths 27 and 27' are established in this reflected sound accessory circuit after the delay circuits 24a and 24b providing direct signals at the final stage to the opposite channels.

FIG. 11 is a block diagram showing the reverberation or echo component accessory circuit. The reflected sound series is achieved by feedback imposition and this is added. In the Figure, 31 and 31' are delay circuits which provide the time interval ΔT between each reflected sound while 28 and 28' are level attenuators which furnish level ratios between each reflected sound. 29 and 29' are filters proportional to the spectrum difference from direct sound while 30 is the phase inversion circuit which mutually reverses the phase between both channels.

The following results are achieved by this invention with the above structure:

(1) The sound picture perceived by headphones will have an anterior homing perception and a more natural sound, such as that achieved by speakers. This results through the establishment in a signal treatment device for headphone use of a dip filter circuit having an abrupt 10–20 dB dip in the 7–13 kHz interval of the frequency characteristic.

(2) The characteristics can be adjusted to suit the individual using the signal treatment device for headphones and all people will experience an anterior homing sensation by the incorporation of the dip filter circuit, in which the dip frequency positions can be independently varied in the individual paths which supply signals to the two reproduction units of headphones in a signal treatment device.

What is claimed is:

1. In stereo sound reproduction circuitry for use with a stereo signal source and stereo headphones, the improvement of dip filter means disposed between the stereo signal source and the stereo headphones, said dip filter means having a dip in the transmission characteristic thereof, said dip being in substantially the same frequency position as a dip which occurs in the sound pressure frequency response characteristic at the ear canal entrance when a sound source is disposed in front of a listener, means for varying said dip in the transmission characteristic of said dip filter means between said 7 to 13 kHz and means for controlling the magnitude of the dip in the transmission characteristic of said dip filter means between 10–12 dB whereby said last two-mentioned means permit the stereo sound reproduction circuitry to be accommodated to a plurality of different individuals.

2. In stereo sound reproduction circuitry as in claim 1 including a first one of said dip filter means connected to the right stereo headphone and a second one of said dip filter means connected to the left stereo headphone.

3. In stereo sound reproduction circuitry as in claim 1 including cross talk circuitry connected in series with said dip filter means to provide cross talk equal to the head diffraction sound between both channels of stereo sound reproduction circuitry and an indirect sound accessory circuitry parallel to said cross talk circuitry and said dip filter means.

* * * * *